US005503078A

United States Patent [19]

LeTual

[11] Patent Number: 5,503,078

[45] Date of Patent: Apr. 2, 1996

[54] SHOCK RESISTANT DETONATOR AND METHOD FOR MAKING THE SAME

[75] Inventor: Jean C. LeTual, Lachute, Canada

[73] Assignee: ICI Canada Inc., Ontario, Canada

[21] Appl. No.: 312,445

[22] Filed: Sep. 26, 1994

Related U.S. Application Data

[63] Continuation of Ser. No. 958,255, Oct. 8, 1992, abandoned.

[51] Int. Cl.[6] ..... F42C 19/12

[52] U.S. Cl. ..... 102/202.13; 102/202.11

[58] Field of Search ..... 102/202.5, 202.7, 102/202.8, 202.9, 202.11, 202.13, 202.14, 204, 205

[56] References Cited

U.S. PATENT DOCUMENTS

| | | | |
|---|---|---|---|
| 3,118,375 | 1/1964 | Jagge | 102/202.8 |
| 3,372,640 | 3/1968 | Dow et al. | 102/202.14 |
| 3,937,143 | 2/1976 | Schlueter | 102/202.11 |
| 4,331,078 | 5/1982 | Habbel et al. | 102/202.11 |
| 4,696,231 | 9/1987 | Bryan | 102/204 |
| 4,727,808 | 3/1988 | Wang et al. | 102/202.5 |
| 4,821,646 | 4/1989 | True et al. | 102/322 |

FOREIGN PATENT DOCUMENTS

| | | | |
|---|---|---|---|
| 192823 | 11/1957 | Austria | 102/202.11 |
| 196770 | 3/1958 | Austria | 102/202.11 |
| 199107 | 8/1958 | Austria | 102/202.11 |
| 990138 | 6/1976 | Canada | 102/202.5 |
| 769605 | 8/1934 | France | 102/205 |
| 883335 | 5/1988 | South Africa . | |
| 912311 | 3/1991 | South Africa . | |

*Primary Examiner*—Stephen M. Johnson
*Attorney, Agent, or Firm*—Charles Q. Buckwalter

[57] ABSTRACT

The present invention is directed to an article of manufacture which provides a disc which both cleans primary charge contaminants on detonator cylinder walls, and shapes the preloaded primary charge in the containment chamber of the detonator.

7 Claims, 1 Drawing Sheet

SHOCK RESISTANT DETONATOR AND METHOD FOR MAKING THE SAME

This application is a continuation of Ser. No. 07/958,255, filed Oct. 3, 1992, which is now abandoned.

BACKGROUND

The present invention is directed to detonators, and to an improved detonator structure and method of making the same whereby improved performance and shock resistance are achieved.

A problem in this art is that the walls of a detonator cylinder become contaminated with the primary explosive when loading the primary explosive into the detonator cylinder, also known as the casing. This is a problem since detonator walls contaminated with the primary explosive may result in several different kinds of failure modes. An additional problem is that once the primary charge is loaded, the shape of the charge has been determined by the cylinder dimensions on three sides of the loaded primary charge. The remaining dimension has largely been ignored, thereby ignoring the optimum shape for detonating purposes.

This art knows that removing the primary charge contaminant from the sides of the detonator cylinder walls provides a more reliable detonator. This has been addressed by what those skilled in this art term a "wiper ring." The wiper ring concept is disclosed in U.S. Pat. No. 4,821,646 issued Apr. 18, 1989, incorporated herein by reference. Therein disclosed is a means of wiping the cylinder wall to provide a cleaner cylinder wall surface. There is no mention of shaping the primary charge.

SUMMARY OF THE INVENTION

The present invention provides an improved means of removing and/or cleaning primary charge contaminants from the detonator cylinder walls after loading, and shaping the preloaded primary charge in the primary charge containment chamber in the detonator. In cleaning the cylinder walls of the detonator by the means disclosed hereunder, a detonator is provided which exhibits a much higher degree of reliability and provides a greater quantum of shock resistance, decreasing the sensitivity of the detonator to sympathetic propagation. Additionally, it is revealed that shaping the primary explosive may be accomplished with the same means as is used to decontaminate the detonator cylinder walls. Heretofore, affirmatively shaping the primary explosive has been largely ignored. Hereunder, it is disclosed that conical shaping of the primary charge after loading provides more consistent detonation results. The means used to decontaminate the cylinder walls is a disc with an outside diameter which is less than, equal to, or larger than the inside diameter of the detonator cylinder walls. The present invention is found useful in detonators and may be useful in squibs for the purpose of increasing shock resistance.

The detonator comprises an elongated casing having an internal wall, a charge of either or both a primary and secondary explosive charge within said casing and extending lengthwise along a first part of the interior of the casing, a charge of delay material extending along another part of the interior of the casing, the internal wall of at least said other part of the interior of the casing being cylindrical, and a disc disposed between said charge of primary explosive and said charge of delay material wherein said delay element contacts said first charge along an area substantially equal in size to an area of an aperture in said disc, the size of said disc being such that its outer periphery is engageable with said cylindrical internal wall as the disc is moved lengthwise within said casing toward said first part of the interior thereof, whereby residue of said primary explosive is substantially scraped or substantially removed from said wall as said disc is inserted into said casing, and said disc having a face exposed to said primary explosive and shaped in the form of a surface of revolution, whereby engagement of said disc with said charge of primary explosive causes said charge of primary explosive to assume the form of a shaped charge.

In the alternative, the invention comprises an article of manufacture wherein said article is a detonator comprising a front sided and a back sided disc made to conform to a cylinder wherein said disc comprises a front sided x-axis, y-axis, and z-axis said y-axis centerably fixed in a centerably fixed orifice of said disc and said front sided x-axis sloped three dimensionally in a symmetric and/or an asymmetric geometry or some combination thereof, toward said y-axis by a single and/or plurality of angles said angles greater than 0 degrees but less than 90 degrees referenced to said y-axis and concentrically radiating about said z-axis, whereby said disc is insertably and slidably mated to said cylinder and wherein said sloped x-axis is front sidedly inserted into said cylinder. Said z-axis is generally concentric and/or symmetrical about said x and y axis. Said x-axis tends to be the working axis. Upon insertion, said disc frictionally wipes the sides of said cylinder until coming to rest juxtaposed to and shaping thereby, a primary explosive charge. Said shape forms a reflective of said front sided disc. The primary explosive charge communicates with a secondary explosive charge on its opposite side from said disc. The secondary explosive charge is bottomed on the closed end of the cylinder.

FIG. 1 shows said article in combination with a detonator mechanism wherein 1 is said disc, 2 is said front sided x-axis sloped dimensionally toward said y-axis, 4, said y-axis centerably fixed in said orifice 5, said orifice 5 centerably fixed in said article 1. A delay element 7, resides within a channel 8, wherein said orifice 5 is mateably communicating with said channel 8 and said delay element, 7. Said front sided x-axis, 2, communicates with said primary charge, 11, said primary charge, 11, communicating with a secondary charge, 12. Elements 1, 2, 4, 5, 7, 8, 10, 11, and 12 reside in combination with a cylinder counterpart, 9.

FIGS. 2 through 6 show additional configurations of a cut away of said disc, 1. FIG. 2 shows the front sided x-axis, 2, slope of element 1, wherein said slope makes an approximate 60 degree angle towards a planar x-axis, 6, meeting on either side at the centerably fixed y-axis, 4. FIG. 2 shows two small orifices, **13*a* and 13*b***, equidistant from the centerably fixed y-axis.

FIG. 3 shows the front sided x-axis, 2, as an arc. Said arc joining the planar x-axis, 6, and meeting on either side at the centerably fixed y-axis, 4. Similar to FIG. 2, FIG. 3 shows elements **13*a* and 13*b***.

FIGS. 2 through 6 are intended as illustrative configurations of the disc, 1, and are not intended to represent the only configurations possible for the disc.

Figure 1:
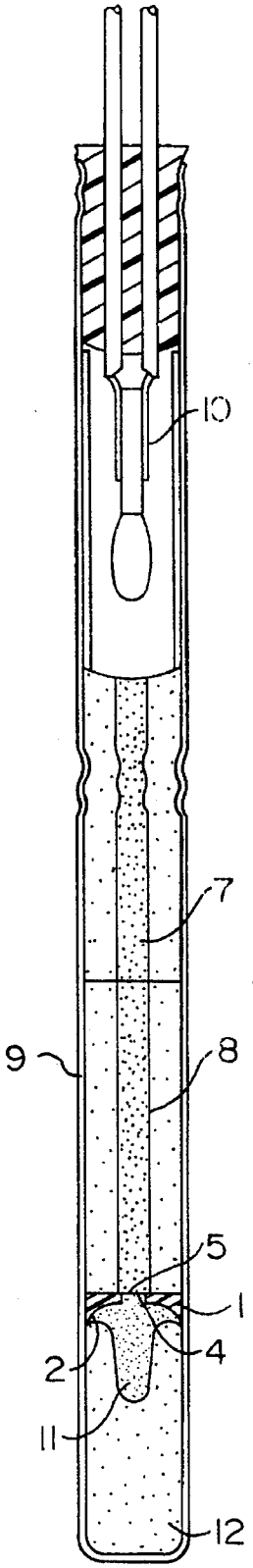
Figure 2:
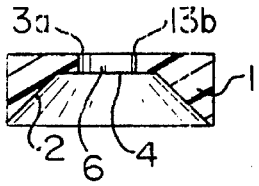
Figure 3:
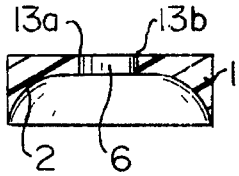
Figure 4:
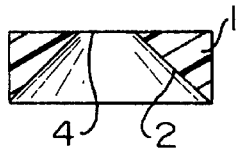
FIG. 4 shows a similarly sloped x-axis, 2, as that in FIG. 2, without the thicker planar x-axis, said sloped x-axis, 2, meeting on either side at said centerably fixed y-axis orifice, 4.
Figure 5:
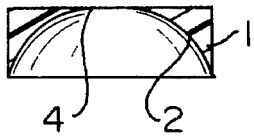
FIG. 5 shows a disc, 1, with a similar arc to that in FIG. 3, without the thicker planar x-axis, said arc x-axis, 2, meeting on either side at said centerably fixed y-axis orifice, 4.
Figure 6:
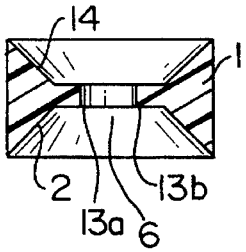
FIG. 6 shows a front sided, 2, and back sided, 14, sloped x-axis said front and back sided sloped and meeting on either side of the planar x-axis, 6, toward the centerably fixed y-axis, 4. Orifices 13*a* and 13*b* are present in this particular embodiment.

The disc is preferably circular comprising a centered orifice. Preferably, the front sided slope of the x-axis which is in communication with the primary charge is generally a symmetrical geometry about the y-axis with the slope angle between the x-axis and y-axis ranging from about 15 to 75 degrees, most preferably from about 30 to 60 degrees. It is preferred to have one orifice centered in said disc, the diameter of said orifice 5 is preferably less than or equal to the mated channel 8 in said delay element. The delay element comprises channel 8 of a certain diameter, ranging from about 0.127 centimeters to about 0.75 centimeters, said channel filled with a compressed pyrotechnic composition. It is most preferred that said orifice 5 in said disc is a smaller diameter than said channel 8 in said delay element. Delay elements are optionally placed on top of and in communication with the disc. While it is contemplated that several delay elements are made to communicate with the disc either directly or indirectly, the disc is operable within the scope of this invention when there is no or only a single delay element. It is preferred that at least one delay element is present in the detonator assembly. Additionally, a thin semi-permeable membrane may be appended to the disc, covering said orifice to provide additional support/formation to the primary charge.

The disc may be comprised of any material that is pliable with memory and resilient, preferably the disc is comprised of a thermoplastic, thermosetting, and/or any alloy thereof, most preferably a low, medium, and/or high density polyethylene. It is preferred that the disc comprises one orifice, however, the disc may be comprised of a plurality of orifices of the same or variable diameter to enable additional communication between the delay element and the primary charge. The overall dimensional diameter of the disc is mateably matched to said cylinder and may be slightly less than, equal to, or greater than the inside diameter of said cylinder. To achieve the advantages contemplated hereunder, the disc must be able to clean the detonator cylinder walls, therefore the mating of the disc and cylinder should be mateably fit to achieve that purpose.

The disc may be complemented with a single and/or plurality of companion wiper rings. A wiper ring is concentrically combined with the disc, forming an interface between a part of the disc and the cylinder wall. The wiper ring may form the entire interface between disc and cylinder or a part thereof. The disc can be combined with a wiper ring, said wiper ring may be under compression, to enable additional wiping of the detonator cylinder walls. Said wiper rings are in intimate communication with the disc and the cylinder walls.

The sloped element of this invention is preferably frusto-conical in shape with the frusto-conical portion of the disc juxtaposed to the preloaded primary charge. Preferably, the disc includes said orifice 5 in the center of said frusto-conical portion.

The disc of the present invention is compatible with both electric and nonelectric detonator mechanisms. The major difference in electric and nonelectric detonating mechanisms is in the opposite end of the detonator, therefore, different initiating systems within the detonator will not impact the operation of the disc.

The primary explosive charge comprises explosives that may be selected from lead azide, lead styphnate, diazodinitrophenol, mercury fulminate, and any other explosive charge that may be used as a primary charge, combinations thereof and therebetween.

The disc is manufactured with existing technology. In its most general description, the technology is simply molding the disc material in its molten form and allowing the form to cool to room temperature. Preferably, the thermoplastic material is injection molded under pressure and allowed to cool to its hardened state. Any means for formably manufacturing a thermoplastic material into the disc may be used for the purpose of this invention.

The method of forming a detonator comprises the steps of inserting a charge of either or both a primary or secondary explosive charge into a blind cylinder, preferably pressing said charge at a force sufficient to consolidate the explosive charges, thereafter inserting into said cylinder a disc having a face in the form of a surface of revolution and outer periphery of a size to engage the interior wall of the cylinder as it is inserted, moving said disc toward the cylinder as it is inserted, moving said disc toward said charge and scraping residue of said primary explosive from the interior wall of said cylinder by means of said disc as the disc moves toward said charge, and causing said face of the disc to engage said charge and thereby form said charge into a shaped charge.

An advantage of cleaning the walls of the cylinder and shaping the primary charge is the resultant shock resistance. As those in the explosive art know, shock resistance in detonators provides increased probability that the detonator will function at its nominal delay time and will not function sympathetically due to shock. Sympathetic functioning in a blast pattern can cause stemming ejection with increased noise levels, increased vibration levels, poor breakage and throw of the material being blasted.

I claim:

1. A detonator comprising an elongated casing having a substantially uniform cylindrical internal wall, a first charge of primary explosive charge, a second charge of secondary explosive unified within said casing and extending lengthwise along a first part of an interior of the casing, a delay element extending along an other part of said interior of the casing, the internal wall of at least said other part of the casing being cylindrical, and a disc disposed between said first charge and said delay element, a size of said disc being such that said disc outer periphery is engaged along said interior casing, said outer periphery being cylindrical with said internal wall of said casing as the disc is moved lengthwise within said casing toward said first part of the interior thereof, whereby residue of said first and second charge is substantially scraped from said wall as said disc is inserted into said casing, and said disc having a face exposed to said first charge whereby said first charge assumes a shape in a form reflective of said exposed face of said disc wherein said delay element contacts said first charge along an area equal in size to an area of an aperture in said disc.

2. The disc of claim 1 wherein said disc consists essentially of polyethylene selected from the group consisting of low, medium, and high density polyethylene and combinations thereof.

3. The detonator in claim 1 wherein said detonator is nonelectric.

4. The detonator in claim 1 wherein said detonator is electric.

5. The disc in claim 1 wherein said disc is a frustoconical shape.

6. The primary charge in claim 1 selected from the group consisting of lead azide, lead styphnate, diazodinitrophenol, mercury fulminate, and combinations thereof.

7. The disc of claim 1 wherein said disc consists essentially of thermoplastic, thermoset, and alloys thereof.

* * * * *